US010329819B1

(12) United States Patent
Weldon

(10) Patent No.: US 10,329,819 B1
(45) Date of Patent: Jun. 25, 2019

(54) ADJUSTABLE SPRING HINGE AND GATE

(71) Applicant: Weldon Industries, Inc., Tampa, FL (US)

(72) Inventor: Mark Weldon, Tampa, FL (US)

(73) Assignee: THE GOVERNOR AND COMPANY OF THE BANK OF IRELAND, AS COLLATERAL AGENT, Stamford, CT (US)

( * ) Notice: Subject to any disclaimer, the term of this patent is extended or adjusted under 35 U.S.C. 154(b) by 0 days.

(21) Appl. No.: 15/693,048

(22) Filed: Aug. 31, 2017

Related U.S. Application Data

(60) Provisional application No. 62/382,431, filed on Sep. 1, 2016.

(51) Int. Cl.
*E05F 1/12* (2006.01)
*E05D 7/04* (2006.01)

(52) U.S. Cl.
CPC ..... *E05F 1/1215* (2013.01); *E05D 7/0423* (2013.01); *E05F 1/12* (2013.01); *E05Y 2600/626* (2013.01); *E05Y 2900/40* (2013.01)

(58) Field of Classification Search
CPC ..... E05D 7/0423; E05D 2015/585; E05D 2015/586; E05F 1/1215; E05F 1/12; E05Y 2900/40; E05Y 2900/402
USPC ..... 16/86.1, 86.2
See application file for complete search history.

(56) References Cited

U.S. PATENT DOCUMENTS

| | | | | |
|---|---|---|---|---|
| D443,196 | S | 6/2001 | Sosa | |
| 7,895,713 | B2 * | 3/2011 | Williams, Jr. | E05D 5/06 16/238 |
| 8,286,305 | B2 * | 10/2012 | Singleton | E05D 7/04 16/253 |
| 8,656,557 | B2 * | 2/2014 | Stull | E05D 5/06 16/245 |
| D817,146 | S * | 5/2018 | Weldon | D8/323 |
| 2005/0241106 | A1 | 11/2005 | Sosa et al. | |

* cited by examiner

*Primary Examiner* — Roberta S Delisle
(74) *Attorney, Agent, or Firm* — Christopher Paradies; Paradies Law P.A.

(57) ABSTRACT

A gate has an adjustable spring hinge with an L-shaped member joining a first bracket to a second bracket by a rotatable bolt that extends through the L-shaped member and threadingly engages a sleeve. One end of the L-shaped member is coupled to the adjustable spring hinge, which is coupled to one of the two brackets. The other of the two brackets includes the sleeve that engages a threaded shaft of the bolt. Thus, a gap width between the first bracket and the second bracket is adjusted by rotating the bolt in a first direction or a second direction, opposite of the first direction.

9 Claims, 8 Drawing Sheets

FIG. 6
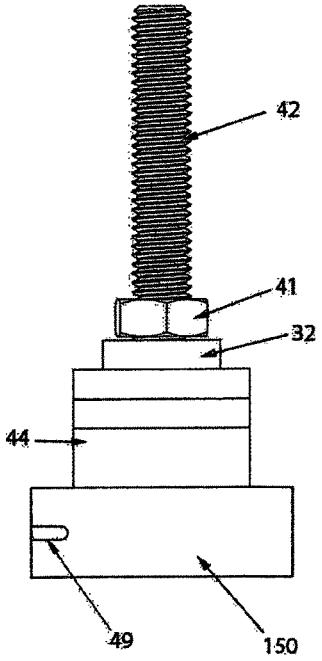
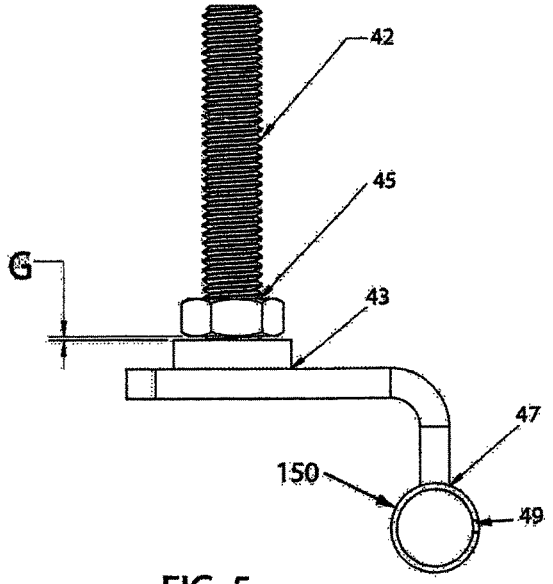
FIG. 5
FIG. 7
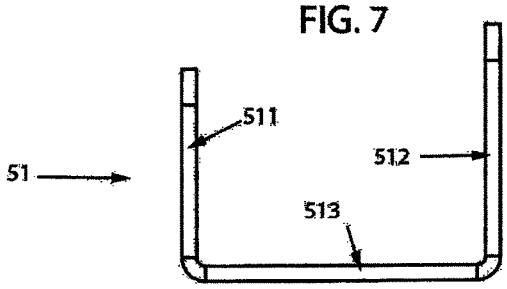

ADJUSTABLE SPRING HINGE AND GATE

CROSS RELATED APPLICATIONS

This application claims priority to the filing date of U.S. provisional application No. 62/382,431, which was filed on Sep. 1, 2016, the entirety of which is hereby incorporated by reference.

FIELD OF THE INVENTION

The field relates to gate hardware, especially hinges for gates.

BACKGROUND

U.S. Pat. No. D443,196 discloses an adjustable gate hinge having an adjustment mechanism for adjusting the distance between a gate bracket and a post bracket. However, this bracket causes the line of the fence and gate to be interrupted due to the nature of the hinge adjustment mechanism. US Pat. Publ. 20050241106 shows a different mechanism for making the same adjustment. None of the known adjustment mechanisms are both simple to adjust and easy to manufacture, without interrupting the line of the fence post and gate.

SUMMARY

A gate comprises a gate bracket, a post bracket and an adjustable spring hinge comprising an adjustment mechanism for adjusting the distance between the gate bracket and the post bracket. The adjustment mechanism may comprise an L-shaped member attached at a first end to an adjustable spring assembly for adjusting the tension applied to a spring contained in a cylindrical housing, for example. In one example, the cylindrical housing is welded to the first end of the L-shaped member. A second end, distal to the first end of the L-shaped member is disposed transversely to the first end by a bend in the member and may have a bolt retainer having a hole through which a bolt passes. The bolt has a bolt head that is retained by the bolt retainer while allowing the bolt to rotate freely. The bolt may have an angular adjustment mechanism, such as a nut fixed onto the bolt by one or more weldments, which may be engaged by a wrench for rotating the bolt in either angular direction of rotation.

The spring hinge further comprises a sleeve extending from an inner surface of the gate bracket. The gate comprises a bore hole extending into a portion of an edge of the gate opposite of the post to which the post bracket is attached, such that the sleeve extending from the gate bracket extends into the bore hole in the edge of the gate. A threaded end of the bolt, opposite of the bolt head, threadingly engages an internally tapped portion of the sleeve. By rotating the bolt in a first angular direction, the bolt threadingly engages the sleeve and shortens the distance between the post bracket and the gate bracket. By rotating the bolt in a second angular direction, opposite of the first angular direction, the rotation of the bolt increases the distance between the post bracket and the gate bracket.

In one example, a gate comprises: a first bracket having at least one mounting flange extending from a surface of the first bracket; a second bracket having a sleeve extending through a surface of the second bracket and arranged such that the sleeve extends into a hole in either the gate or a post disposed adjacent to the gate, when the second bracket is mounted to either the gate or a post disposed adjacent to the gate; and an adjustable spring hinge comprising an adjustment mechanism for adjusting the distance between the first bracket and the second bracket, wherein the adjustment mechanism comprises an L-shaped member attached at a first end to an adjustable spring assembly for adjusting the tension applied to a spring contained in a cylindrical housing, the cylindrical housing being coupled to the at least one mounting flange of the first bracket, and the L-shaped member has a second end, distal to the first end and disposed transversely to the first end by a bend in the L-shaped member, the second end comprising a bolt retainer, and an adjustable bolt comprises a bolt head retained by the bolt retainer and a threaded shaft disposed through the bolt retainer such that the threaded shaft extends transversely to the second end and is threadingly engaged in the sleeve of the second bracket, whereby the second bracket is adjustably coupled to the first bracket by the bolt and a gap width between the first bracket and the second bracket is adjustable via rotation of the bolt within the bolt retainer and sleeve. For example, the cylindrical housing is welded to the first end of the L-shaped member. The bolt may further comprise an angular adjustment mechanism. The angular adjustment mechanism may comprise a nut fixed onto the threaded shaft of the bolt. For example, the nut is fixed by one or more weldments between the nut and the shaft of the bolt. The gap width may be adjustable using a wrench to turn the nut. The second bracket may be mounted to the gate such that the sleeve extends into the hole in the gate and the sleeve is not visible, when the second bracket is coupled to the first bracket by the bolt. For example, the shaft of the bolt threadingly engages an internally tapped, threaded portion of the sleeve.

In one example, a method of adjusting the distance between the first bracket and the second bracket of claim 1, the method comprises rotating the bolt in a first angular direction to increase the gap width; and rotating the bolt in a second angular direction, opposite of the first angular direction, to decrease the gap width.

BRIEF DESCRIPTION OF THE DRAWINGS

The following drawings are illustrative examples and do not further limit any claims that may eventually issue.

FIG. 5 illustrates a bottom, detail view of an example of an adjustment mechanism.

FIG. 6 illustrates a side view of the example in FIG. 5.

FIG. 7 illustrates a top, detail view of a gate bracket.

When the same reference characters are used, these labels refer to similar parts in the examples illustrated in the drawings.

DETAILED DESCRIPTION

Figure 1:
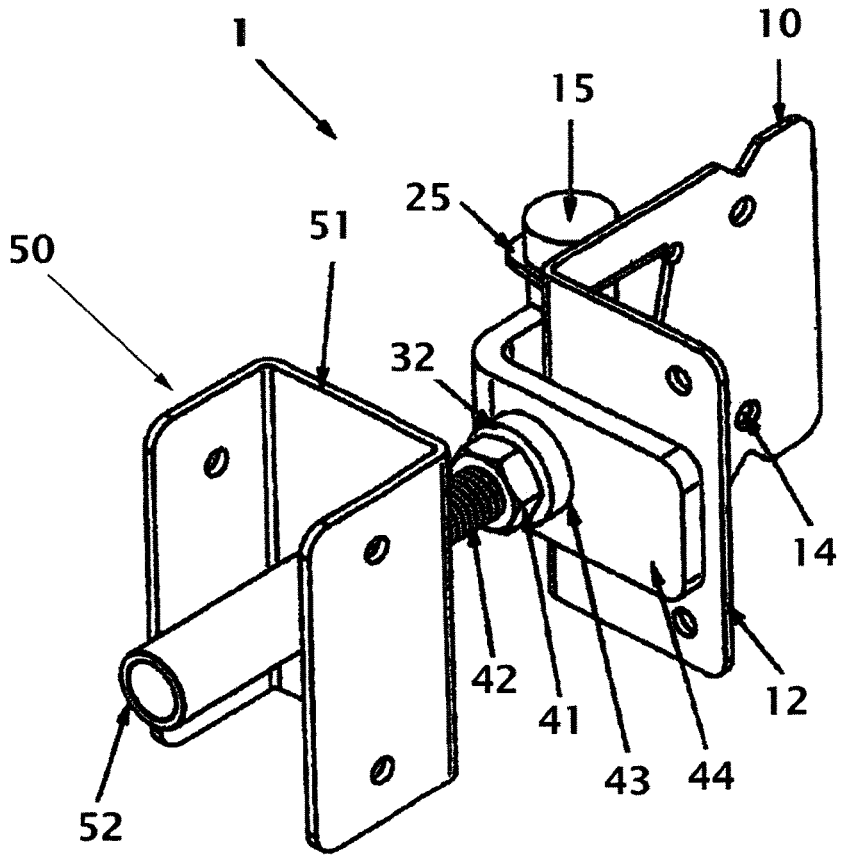
FIG. 1 illustrates a perspective view of an example of an adjustable spring hinge.
Figure 2:
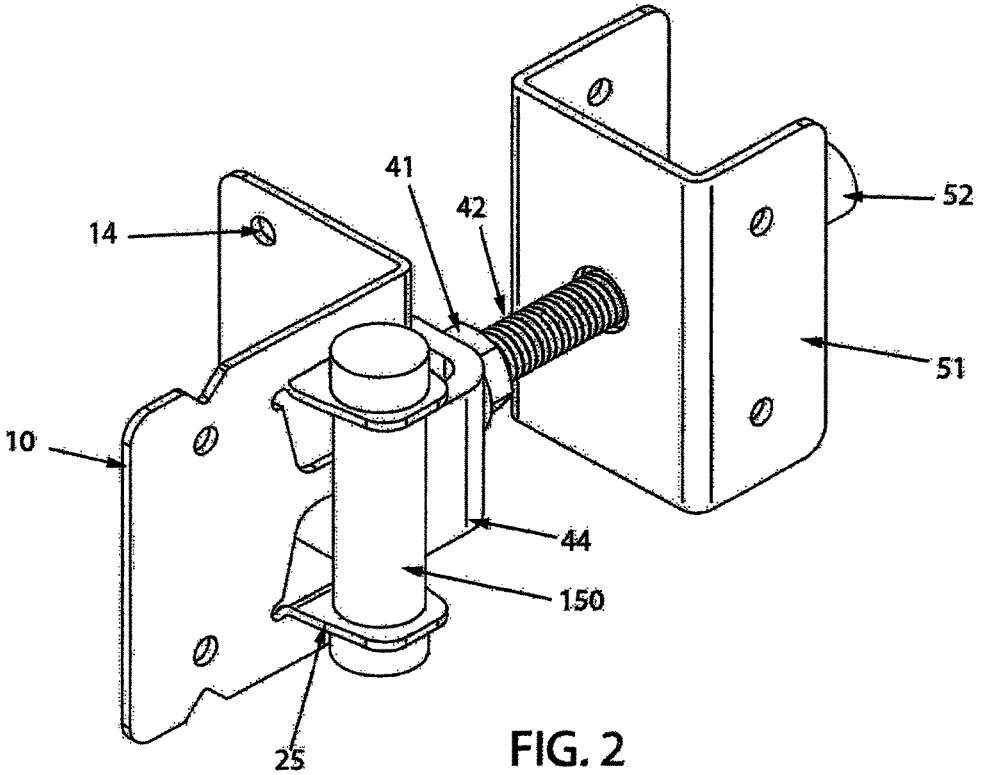
FIG. 2 illustrates another perspective view of the example in FIG. 1.
Figure 3:
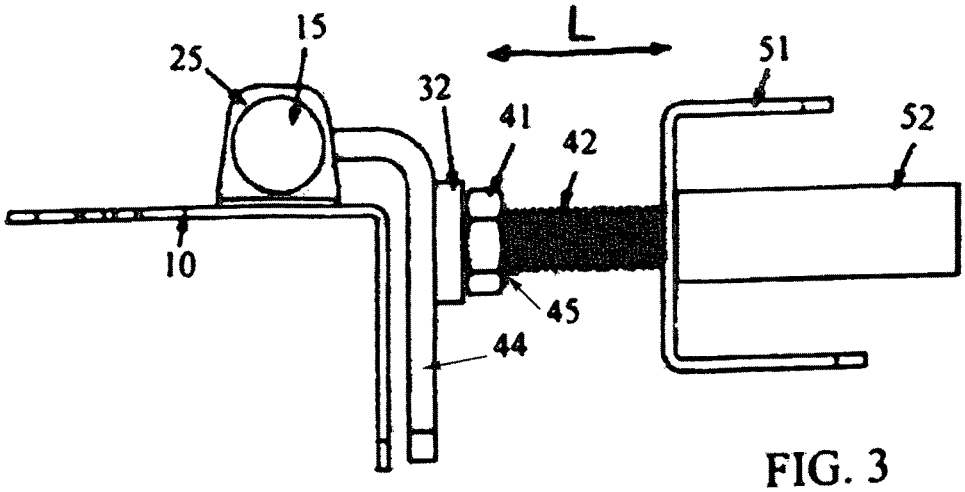
FIG. 3 illustrates a top view of the example in FIG. 1.
Figure 4:
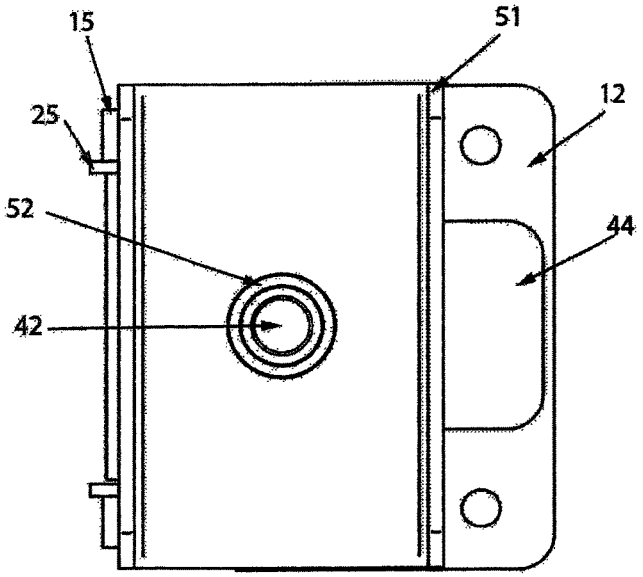
FIG. 4 illustrates an end view from the gate bracket end of the example in FIG. 1.
Figure 10:
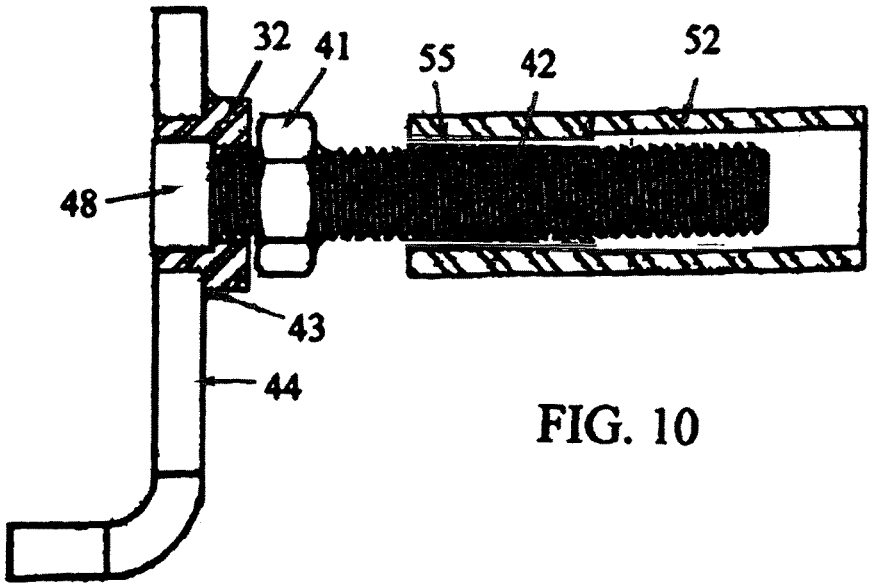
FIG. 10 illustrates a partial cutaway, detail view of an example of an adjustment mechanism.

The illustrations in FIGS. 1-3 illustrate various views of an example of an adjustable spring hinge. FIG. 3 shows a distance L that is adjustable by the adjustable spring hinge 1. The sleeve 52, as best visualized in the partial cutaway view of FIG. 10, is an annular cylinder with a through hole and a tapped portion for threadingly engaging a threaded portion of a bolt 42. The bolt 42 is retained in an L-shaped member 44 by a bolt retainer 32. For example, the bolt retainer 32 comprises a recessed portion in which a rounded bolt head 48 is rotatably retained and a hole through which the threaded portion of the bolt 42 passes. In this example, the bolt retainer 32 is welded to the L-shaped member 44 by a weldment 43. Alternatively, other attachment mechanisms may be used for attaching the bolt retainer 32 in or onto the L-shaped member 44, such as threads, adhesives or mechanical fasteners, such as nuts or retaining rings. One advantage of the bot retainer 32 illustrated in FIG. 10 is that nothing extends beyond the inner surface of the L-shaped member 32. As best seen in FIG. 3, this means that the L-shaped member 44 may be disposed very near the surface of an outer surface of the post bracket 10. Two tabs 25 may be formed by machining and bending portions of post bracket 10. A spring hinge mechanism 15 is shown schematically in the drawings and may comprise a helical coil spring with adjustable tension mechanism, for example. One end of the spring may extend into a hole or slot in the top portion of the spring mechanism 15, as is known in the art. An opposite end of the spring may be disposed in a slot 49 in one end of a spring housing 150 that is attached to the L-shaped member 44, as best shown in the drawings of FIGS. 5 and 6, for example. For example, a weldment 47 may be used to join the housing 150 to the L-shaped member 44. As best illustrated in FIG. 5, a gap G may be defined between a nut 41 welded to the bolt 42 by one or more weldments 45, allowing the nut 41 and bolt 42 to rotate freely in a first angular direction and a second angular direction opposite of the first angular direction. As shown in FIG. 10, rotation of the nut 41 and bolt 42, such as by using a wrench (not shown), threadingly engages a tapped inner surface 55 of the sleeve, moving the sleeve 52 away from or toward the L-shaped member 44, depending on the angular direction of rotation of the nut 41 and bolt 42. As shown in the end view of FIG. 4, the bolt 42 attaches the L-shaped member to the gate bracket by way of the sleeve 52.

Figure 8:
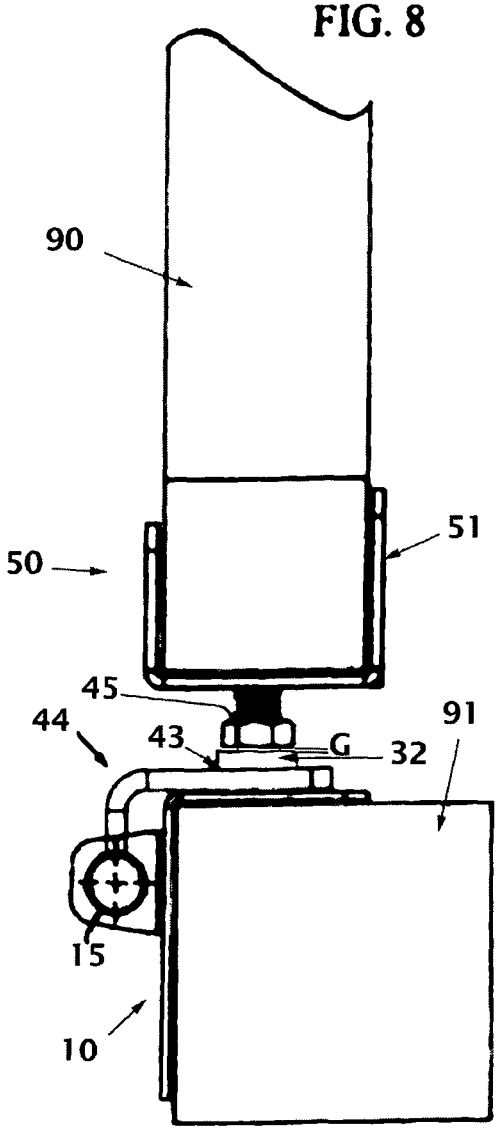
FIG. 8 illustrates a top view of the gate bracket of FIG. 7 as mounted on a gate.
Figure 9:
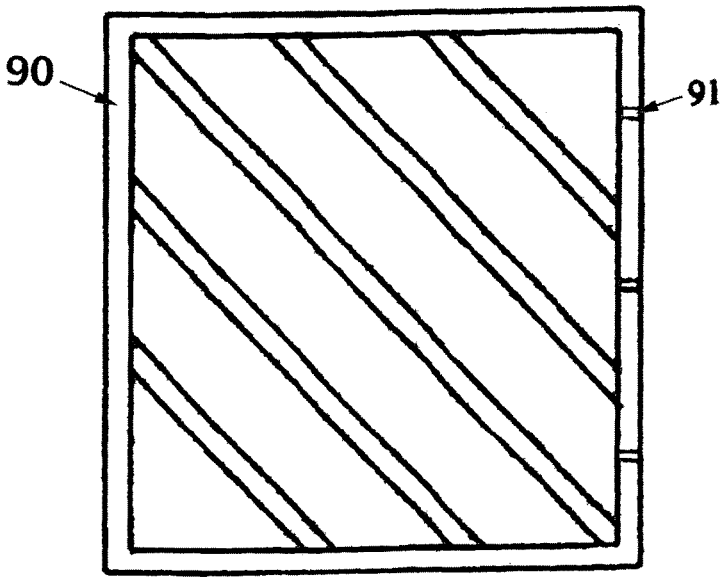
FIG. 9 illustrates an example of a gate.

Holes extending completely through the brackets 10, 51, as illustrated in FIGS. 1 and 2, for example, may be used to attach the brackets to a post 91 and an edge of a gate 90, as best shown in the detail view of FIG. 8, for example. FIG. 7 details how the gate bracket 51 is formed from a metal sheet having a first end 511 and a second end 512 extending away from a connecting portion 513. As can be seen in this example, the second end 512 is longer than the first end 511. Thus, even when the holes 14 are disposed at a midline of the first and second ends 511, 512, fasteners, such as nails or screws won't impinge one on the other, even if long enough to overlap each other. FIG. 9 illustrates an example of a gate 90 with the dashed lines 91 illustrating hidden lines of holes formed or bored into the edge of the gate 90. Thus, in this example, three gate brackets 50 each comprising a sleeve 52 attached to a mounting bracket 51 may be attached by inserting each sleeve 52 into each of the three holes 91 and fastening the mounting brackets 51 to the gate 90 using fasteners extending through the holes 14. As illustrated in FIG. 8, the post corner bracket 10 may be mounted, likewise, to a post 91 by fasteners. In one example, a prefabricated gate comprises preinstalled brackets 50. Three corner brackets 10 may be installed on a gate post 91 of a fence at a set spacing by measurement or using a template to position the corner brackets 10 at the correct locations. The gate 90 may be installed on the gate post 91 by lining up the bolts 42 in the sleeves 52 and rotating the nuts 41 to engage the threaded inner portion 55 of the sleeves 52 for each of the gate brackets 50. By adjusting the distance L between the two brackets, the gate 90 may be appropriately leveled, even if the post is not perfectly plumbed and the ground is not perfectly level below the gate 90. As illustrated in FIG. 8, the gate 90 may be disposed flush with an exterior surface of a fence post 91 by disposing the bolt retainer 32 at a position in the L-shaped member 44 that makes the surface of the gate bracket 50 flush with the gate post bracket 10.

This detailed description provides examples including features and elements of the claims for the purpose of enabling a person having ordinary skill in the art to make and use the inventions recited in the claims. However, these examples are not intended to limit the scope of the claims, directly. Instead, the examples provide features and elements of the claims that, having been disclosed in these descriptions, claims and drawings, may be altered and combined in ways that are known in the art.

What is claimed is:

1. A gate comprises:

a first bracket having at least one mounting flange extending from a surface of the first bracket;

a second bracket having a sleeve extending through a surface of the second bracket and arranged such that the sleeve extends into a hole in either the gate or a post disposed adjacent to the gate, when the second bracket is mounted to either the gate or the post disposed adjacent to the gate; and an adjustable spring hinge comprising an adjustment mechanism for adjusting a gap width between the first bracket and the second bracket, wherein the adjustment mechanism comprises an L-shaped member attached at a first end to an adjustable spring assembly for adjusting the tension applied to a spring contained in a cylindrical housing, the cylindrical housing being coupled to the at least one mounting flange of the first bracket, and the L-shaped member has a second end, distal to the first end and disposed transversely to the first end by a bend in the L-shaped member, the second end comprising a bolt retainer, and an adjustable bolt comprises a bolt head retained by the bolt retainer and a threaded shaft disposed through the bolt retainer such that the threaded shaft extends transversely to the second end and is threadingly engaged in the sleeve of the second bracket, whereby the second bracket is adjustably coupled to the first bracket by the bolt and the gap width between the first bracket and the second bracket is adjustable via rotation of the bolt within the bolt retainer and the sleeve.

2. The gate of claim 1, wherein the cylindrical housing is welded to the first end of the L-shaped member.

3. The gate of claim 1, wherein the bolt further comprises an angular adjustment mechanism.

4. The gate of claim 3, wherein the angular adjustment mechanism comprises a nut fixed onto the threaded shaft of the bolt.

5. The gate of claim 4, wherein the nut is fixed by one or more weldments.

6. The gate of claim 5, wherein the gap width is adjustable using a wrench to turn the nut.

7. The gate of claim 1, wherein the second bracket is mounted to the gate such that the sleeve extends into the hole in the gate and the sleeve is not visible, when the second bracket is coupled to the first bracket by the bolt.

8. The gate of claim 7, wherein the shaft of the bolt threadingly engages an internally tapped, threaded portion of the sleeve.

9. A method of adjusting the gap width between the first bracket and the second bracket of claim 1, the method comprising:

rotating the bolt in a first angular direction to increase the gap width; and rotating the bolt in a second angular direction, opposite of the first angular direction, to decrease the gap width.

* * * * *